US007073984B2

(12) United States Patent
Carey et al.

(10) Patent No.: US 7,073,984 B2
(45) Date of Patent: Jul. 11, 2006

(54) RETAINING WALL CONSTRUCTION ELEMENT AND SHEAR KEY

(75) Inventors: John M. Carey, Ashburn, VA (US); Thomas C. Neel, Springfield, VA (US)

(73) Assignee: The Neel Company, Springfield, VA (US)

( * ) Notice: Subject to any disclaimer, the term of this patent is extended or adjusted under 35 U.S.C. 154(b) by 0 days.

(21) Appl. No.: 10/989,437

(22) Filed: Nov. 17, 2004

(65) Prior Publication Data

US 2006/0104726 A1 May 18, 2006

(51) Int. Cl.
*E02D 29/02* (2006.01)

(52) U.S. Cl. ..... 405/286; 52/586.1; 52/604; 52/605

(58) Field of Classification Search ..... 405/262, 405/286, 284; 52/586.1, 586.2, 604, 605
See application file for complete search history.

(56) References Cited

U.S. PATENT DOCUMENTS

| | | | | |
|---|---|---|---|---|
| 4,684,294 | A | | 8/1987 | O'Neill |
| 4,884,921 | A | * | 12/1989 | Smith ..... 405/286 |
| 5,282,700 | A | * | 2/1994 | Rodrique ..... 405/284 |
| 5,471,811 | A | * | 12/1995 | House et al. ..... 52/745.1 |
| 5,528,873 | A | * | 6/1996 | Correia et al. ..... 52/605 |

* cited by examiner

*Primary Examiner*—Sunil Singh
(74) *Attorney, Agent, or Firm*—Dennison, Schultz & MacDonald

(57) ABSTRACT

A precast concrete retaining wall construction element for retaining a soil mass in a railway installation or the like includes an upstanding solid face panel having the shape of a hexahedron where a rectangular front wall and an integral stem. The front wall defines an area of between about 18.75 and 75 square feet and wherein the ratio of the width of the face panel to its height is between about 0.75 to about 3.0. A reinforced element including an upward extension, an improved shear key and stacked arrangement are also disclosed.

2 Claims, 13 Drawing Sheets

FIG. 16
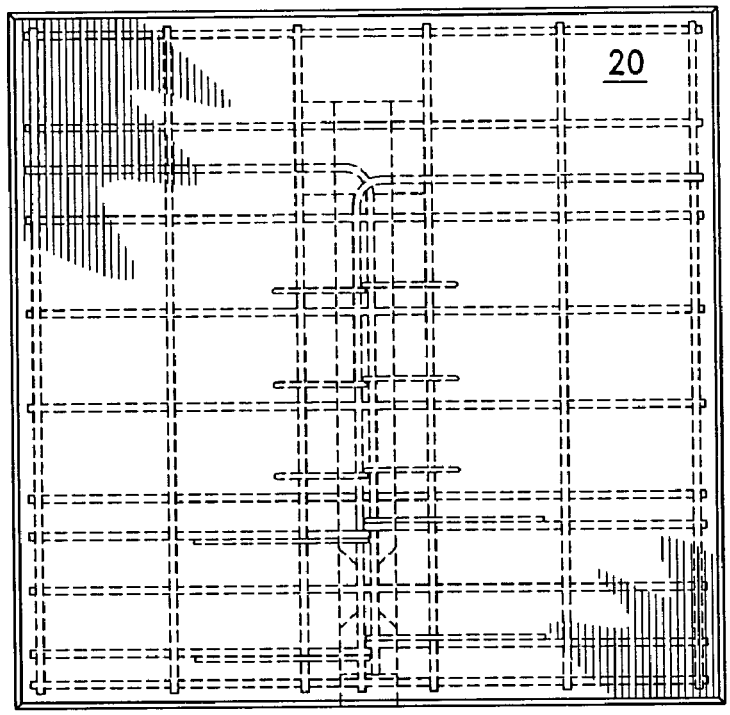
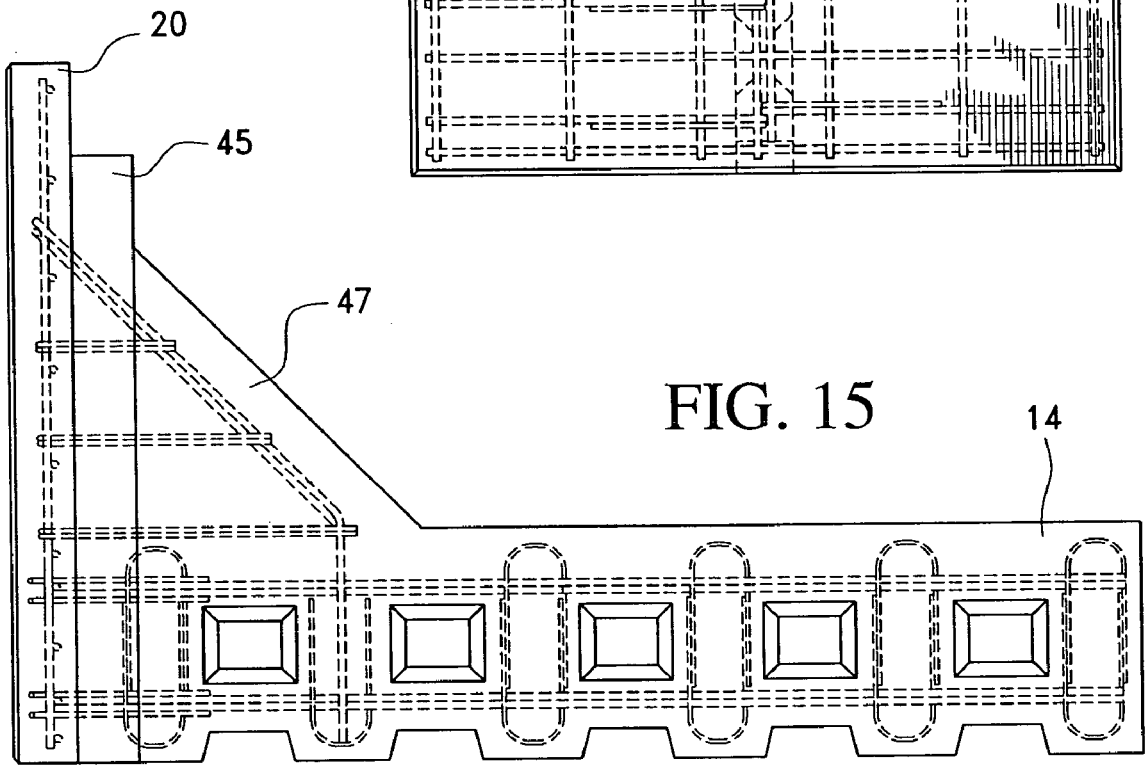
FIG. 15
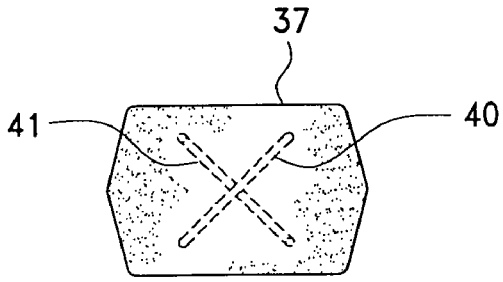
FIG. 17A
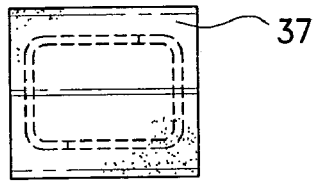
FIG. 17B

RETAINING WALL CONSTRUCTION ELEMENT AND SHEAR KEY

FIELD OF THE INVENTION

This invention relates to a precast concrete retaining wall construction element and more particularly to a precast concrete retaining wall construction element for retaining a soil mass.

BACKGROUND FOR THE INVENTION

Precast concrete retaining wall construction elements are known. For example, a U.S. Patent of O'Neill, U.S. Pat. No. 4,684,294, discloses a retaining wall construction element having a forwardly disposed rectangular face panel and an integral embedment beam which extends into and is anchored by the soil mass. The embedment beam includes upper and lower walls, side walls and a sloping rear wall. In addition, the embedment beam includes notches for engagement which transverse support beams which form a soil interruption system to reduce internal pressure and which serve to lock the embedment beams together. The embedment beams further include pan inserts and a V-shaped groove disposed in the sloping rear wall to increase the frictional engagement between the embedment beam and the soil mass. The construction elements in accordance with the O'Neill patent have been widely used for many applications.

However, it is presently believed that there is a large commercial market for an improved precast concrete retaining wall construction element in accordance with the present invention. There should be a large commercial market for such elements because they are particularly applicable for railroad embankments and other large installations that may be repeatedly subjected to significant forces and/or vibrations.

The improved precast concrete retaining wall construction elements in accordance with the present invention fully meet the American Railway Engineering and Maintenance Association (AREMA) requirements for railroad installations. Further, such elements are economical to manufacture, ship and to install in a safe manner which reduces the risk for employees working on such installations. Further, the precast concrete retaining wall construction element in accordance with the present invention, are sized for efficient shipment by truck and have a pleasing appearance.

BRIEF SUMMARY OF THE INVENTION

In essence, the present invention contemplates a precast concrete retaining wall construction element for retaining a soil mass. The element includes an upstanding solid face panel having the shape of a hexahedron with front and rear walls, a top wall, two side walls and a bottom wall. An important feature of the present invention resides in the area of the front wall which is between about 18.75 and about 75 square feet and wherein the ratio of the width of the face panel to the height of the face panel is between about 0.75 to about 3.0.

In a preferred embodiment of the invention, a "standard unit" includes a front wall having an area of between about 30 square feet and about 40 square feet, preferably about 37½ square feet and wherein the ratio of the width of the face panel to the height of the face panel is between about 0.75 to about 3.0, and preferably between about 1.2 to about 1.6.

The element also includes an integral stem or embedment member extending rearwardly from the rear wall of the face panel in a generally T-shaped construction. The integral stem has an upper wall, a bottom wall, two side walls, a rear wall and with one or more notches defined in the upper and bottom wall. Further, each of the side walls of the integral stem includes one or more pan inserts therein. A shear key is constructed and dimensioned to fit within one of the notches in one of the upper and bottom walls of the stem and is adapted to fit within a corresponding notch in an abutting stem of a second element which is placed on top of or below the retaining wall construction element.

In a second embodiment of the invention, the precast concrete retaining wall construction element wherein each of the elements set forth in the previous paragraph includes steel reinforcing rods extending through and encased by the integral stem and the face panel with one of the reinforcing bars extending outwardly in a first direction of the face panel and the other of the reinforcing bars extending outwardly in an opposite direction into the face panel.

In a third embodiment of the invention, the precast retaining wall construction element for retaining a soil mass includes the elements of the first embodiment of the invention and also includes one or more shear keys which fit within one of the notches in one of the upper or bottom walls and is adapted to fit within a corresponding notch in an abutting stem of a second element placed on top of or below the retaining wall construction element. In this embodiment of the invention, the shear key includes a face having a cross sectional area of about one square foot.

A fourth embodiment of the invention includes all of the elements of the first embodiment. However, in this embodiment the face panel includes an extension extending upwardly above the integral stem by distance of up to about 5 feet. A 5 foot extension on top of a 5 foot height of a standard unit gives a total height of 10 feet which is the limit due to shipping and results in a face panel having a cross sectional area of about 75 square feet. In this example, the area of the upper extension and the portion of the front wall below the extensions are each about 37½ square feet.

A fifth embodiment of the invention contemplates a plurality of stacked elements wherein a first element as defined in the first embodiment of the invention is stacked on top of an element in an aligned and abutting relationship. In this embodiment of the invention, a retaining wall construction element in accordance with the fourth embodiment of the invention may be used as an upper or top element in the stacked array of such elements. Further, the shear key is constructed and dimensioned to fit within one of the notches in an upper wall of one stem and within a corresponding notch in a bottom wall of the stem of the second element.

The invention will now be described in connection with the accompanying drawings wherein like reference numerals have been used to designate like parts.

DESCRIPTION OF THE FIGURES

FIG. 12(*b*) is a front view of a retaining wall construction element in accordance with another embodiment of the invention;

FIG. 15 is a side view of a retaining wall construction element according to a further embodiment of the invention which shows the steel reinforcing elements;

FIG. 16 is a front view of the elements shown in FIG. 15 and which shows the steel reinforcing rods disposed therein;

FIG. 17A is a side view of a shear key which includes a pair of U-shaped reinforcing bars;

FIG. 17B is a schematic illustration of the front view of a pair of U-shaped reinforcing rods as used in the embodiment of the invention shown in FIG. 15;

DESCRIPTION OF THE PREFERRED EMBODIMENTS OF THE INVENTION

Figure 1:
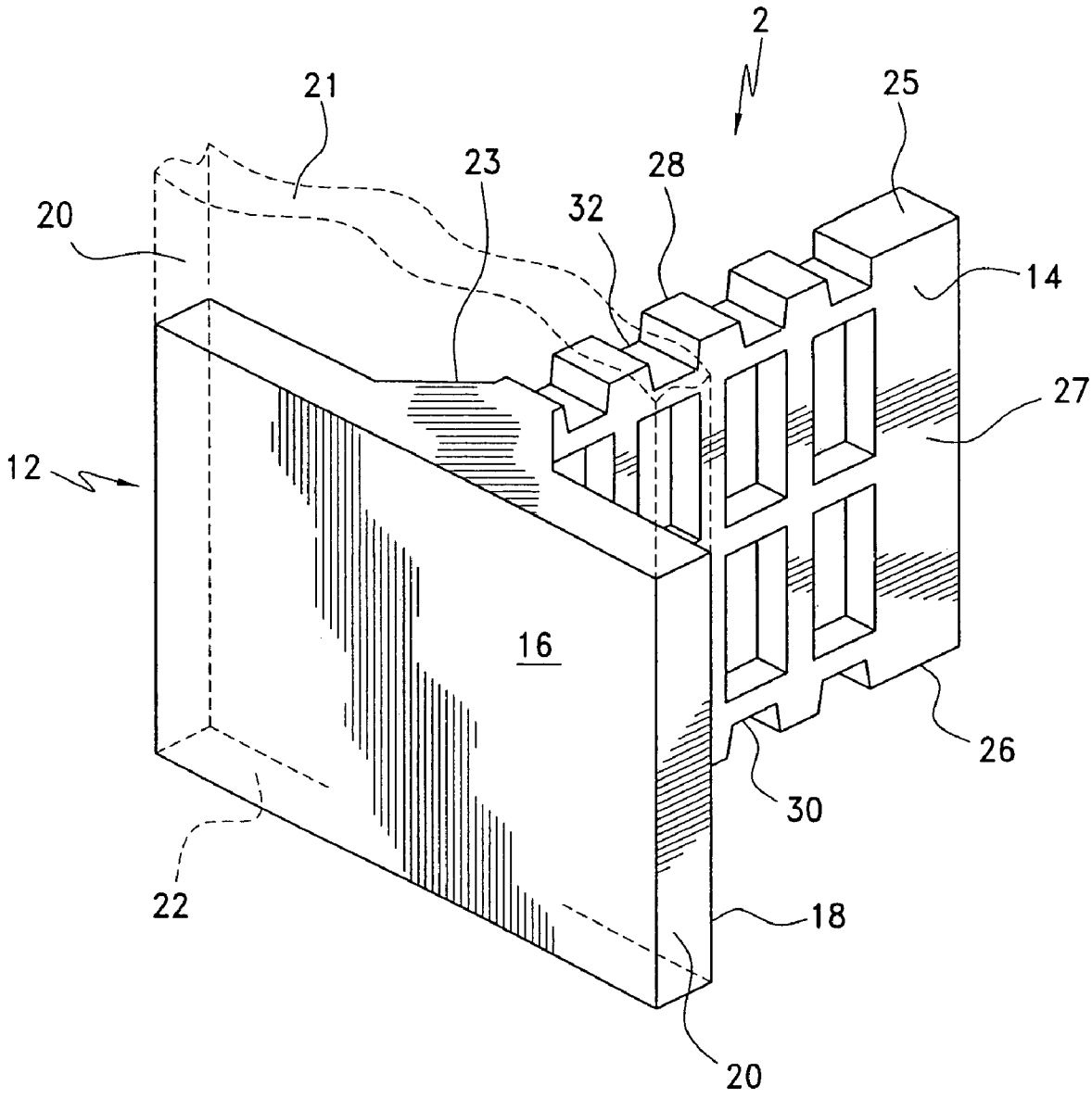
FIG. 1 is a perspective view of a retaining wall construction element in accordance with a first embodiment of the invention.

FIGS. 1, 2, 2A, 2B and 3 show a precast concrete retaining wall construction element 2 in accordance with a first embodiment of the invention. As shown, the element 2 includes a face panel 12 having a height of about 5 feet and a width of about 7½ feet. In a preferred embodiment of the invention, the face panel defines a front face having an area of between about 30 and 40 square feet and preferably about 37½ square feet. The dimensions are based on various considerations including the requirements of the American Railway Engineering and Maintenance Association (AREMA). For example, the lateral pressure required for various installations must be met. In the present case i.e., one that is used for rail facility applications such as grade separation structures, bridge approaches and abutments, slope stabilization etc. each installation must comply with the AREMA requirements and at the same time optimize the value of the installation. For example, dimensions are also based on various considerations including the safety of workers, transportation and manufacturing costs, raw material costs, appearance and loading.

As illustrated, the element 2 includes an integral stem 14 or embedment beam member which is formed in a generally T-shaped arrangement. The face panel 12 and integral stem 14 which are integrally cast from concrete at a manufacturing site. The face panel 12 also includes a forward wall 16, a rear wall 18, side walls 20, a top wall 21 and a bottom wall 22. An integral cast concrete trapezoidal support member 23 extends rearwardly from the rear wall 18 with its base or widest portion adjacent to the rear wall and its top portion extending into the integral stem 14. As illustrated, the top wall 21 defines a flat surface. Also in this embodiment of the invention, the face panel 12 includes an upper extension above the stem 14 which retains additional fill on the top of an installation.

For railroad applications, a number of considerations call for an upward extension of the face panel as for example, as required to allow an overburden of 2 to 3 feet of soil to provide an obstacle free layer of soil below the tracks and above the integral stems. This 1 to 3 feet layer also accommodates for a 1 to 2 percent grade and for electrical cable for signals.

As shown in the figures, the integral stem 14 is joined to the rear wall 18 of the face panel 12 by means of the trapezoidal support member 23 which reduces stress at the juncture. The integral stem 14 includes an upper wall 25, a bottom wall 26 and side walls 27 and 28. The upper wall 25 and lower wall 26 each define one or more notches 30 and 32 for engagement with a shear key (not shown in FIGS. 1 and 2). The side walls 27 and 28 each include a series of pan inserts 33 or indentations which become filled with compacted soil to help hold the element 2 in place within a soil mass.

Figure 2:
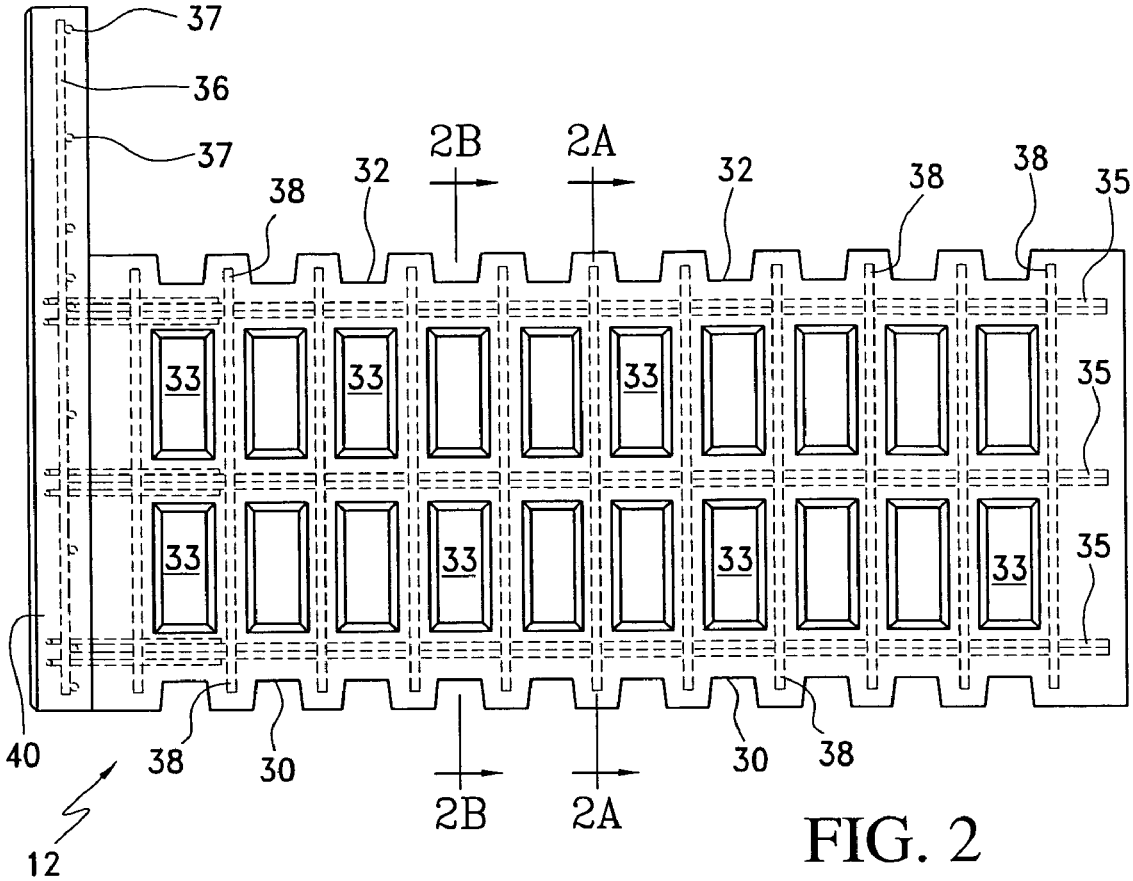
FIG. 2 is a side elevational view of the retaining wall construction element shown in FIG. 1.
Figure 2A:
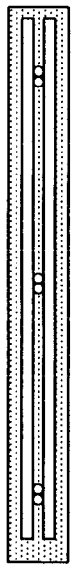
FIG. 2A is a sectional view of the element shown in FIG. 2 and taken along the line A—A in FIG. 2.
Figure 2B:
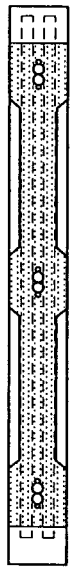
FIG. 2B is a sectional view of the element shown in FIG. 2 and taken along the line B—B in FIG. 2.
Figure 4:
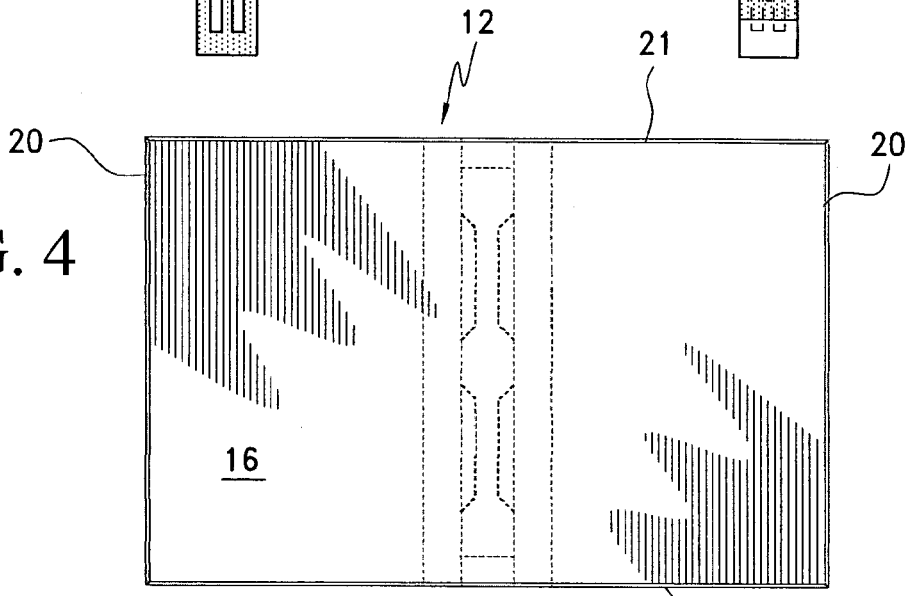
FIG. 4 is a front view of a retaining wall construction element in accordance with a second embodiment of the invention.
Figure 5:
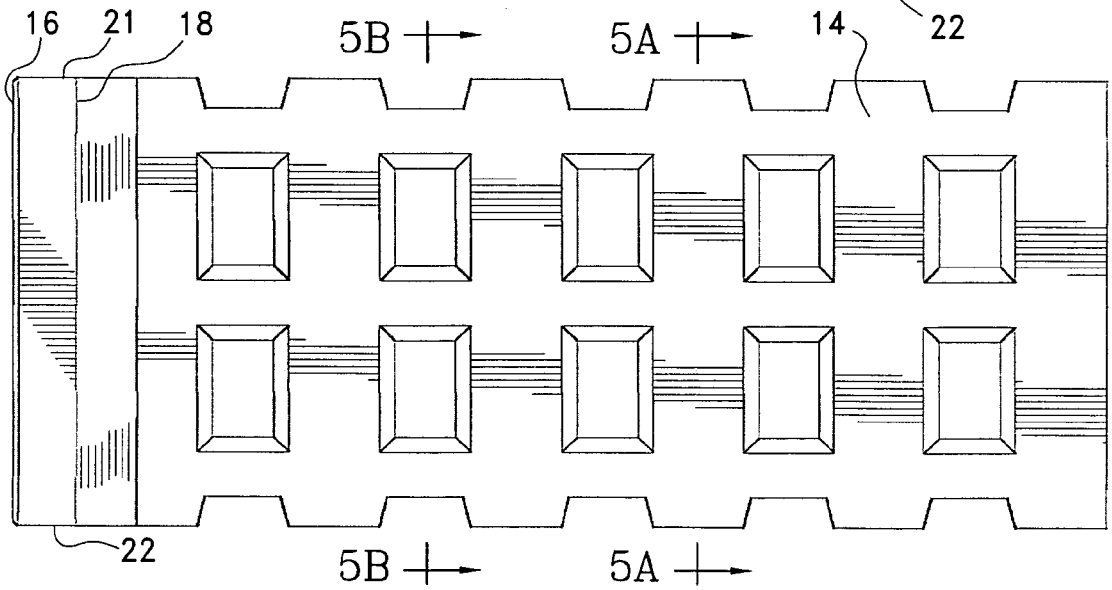
FIG. 5 is a side elevational view of the elements shown in FIG. 4.
Figure 5A:
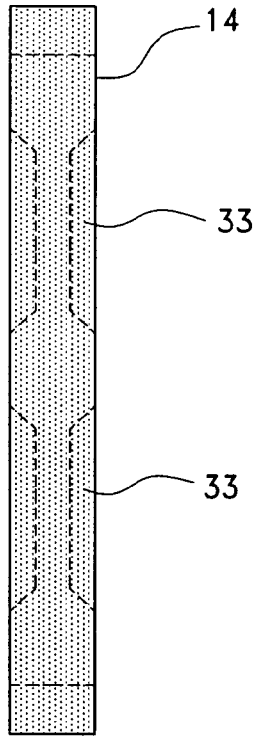
FIG. 5A is a cross-sectional view taken along the line A—A in FIG. 5.
Figure 5B:
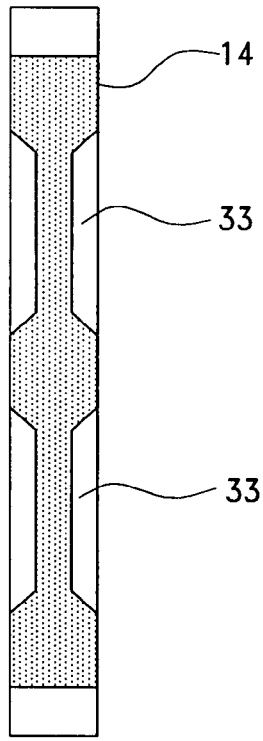
FIG. 5B is a cross-sectional view taken along the line B—B in FIG. 5.
Figure 6:
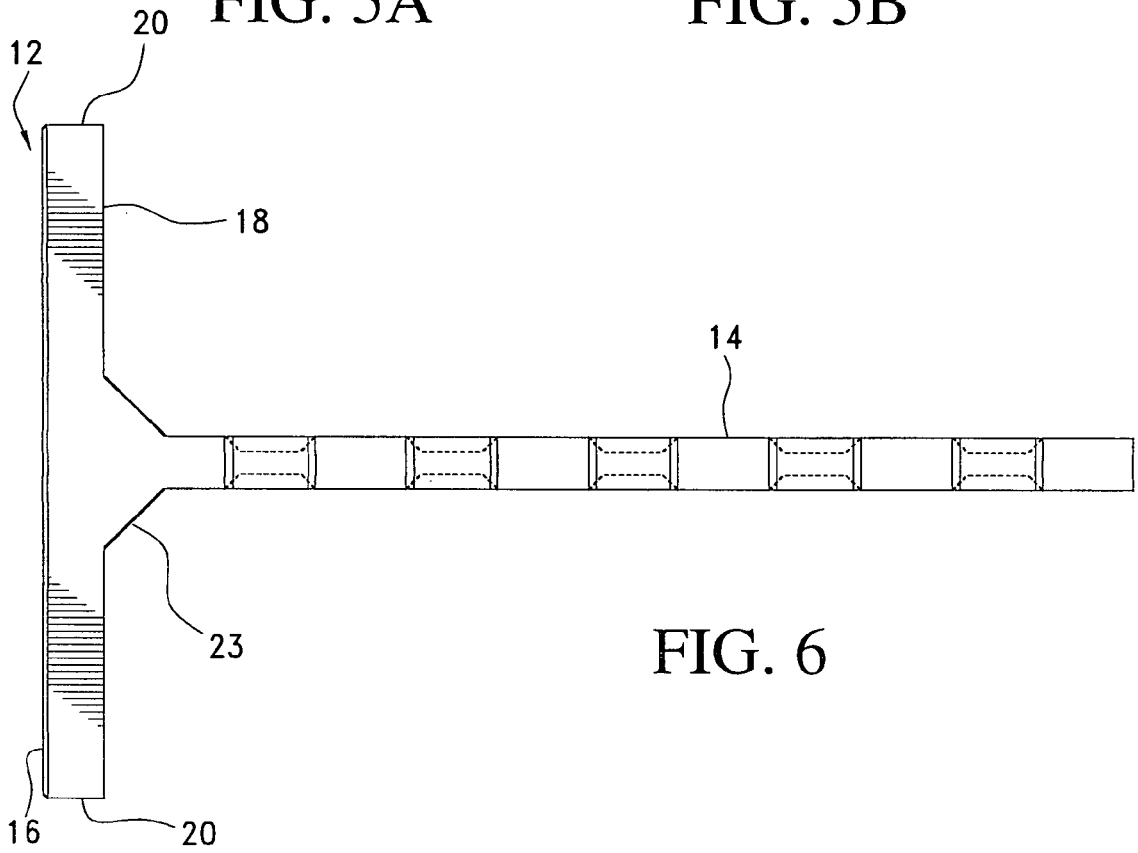
FIG. 6 is a top view of the element shown in FIGS. 4 and 5.
Figure 7:
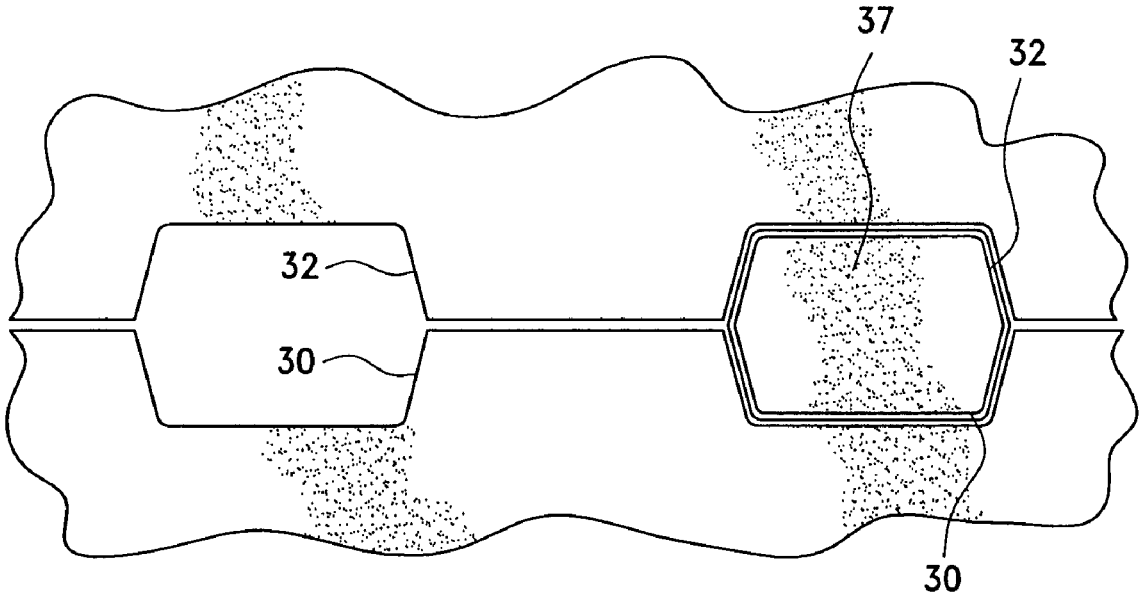
FIG. 7 is a side view of a stem portion of an element in accordance with the present invention and including two pair of corresponding notches and a shear key in one pair of corresponding notches.

FIGS. 2, 2A, 2B and 3 illustrate a preferred embodiment of the invention wherein a plurality of steel reinforcing bars, rods or rebars are used to reinforce the front panel 12 and integral stem 14. As illustrated, the integral stem 14 includes a plurality of pan inserts 33 which are disposed in a plurality of parallel rows and columns. As illustrated, a plurality of completely encased reinforcing sets of rebars 35 extend parallel along the integral stem 14 in an upper and lower portion thereof and in between the horizontal rows of pan inserts 33. The rebars 35 also extend into the front face panel 12. As illustrated, each of the rebar sets include two rebars with one of the rebars extending into the face panel 12 in a first direction and a second of the rebars extending in an opposite direction within the front panel 12. The front panel 12 also includes a plurality of vertically and horizontally disposed rods 36 and 37 respectively. As shown, the rebars 36 and 37 also extend into an upper extension 40 of the face panel 12. A plurality of vertically disposed rebar pairs 38 are disposed in the integral stem 14 with one pair disposed between each column of pan inserts 33 with one of said pair disposed on one side of the rebar 35 and a second of the pairs on an opposite side as shown in FIG. 2A. The arrangement of the horizontal rebars 35 is shown more clearly in FIG. 2B wherein six rebars are shown two in each set of three in the horizontally disposed reinforcing rods.

A further embodiment of the invention is illustrated in FIGS. 4, 5, 5A, 5B and 6. As shown therein the element 2 includes a face panel 12 having a forward wall 16, a rear wall 18, side walls 20, a top wall 21 and a bottom wall 22. The element 2 also includes an integral stem 14 which extends rearwardly from the rear wall 18 to define a T-shaped construction. As illustrated, the stem 14 has the same height as the front panel 12 i.e., about 5 feet and as shown as a length of 12 feet which maybe reduced in successive layers from the bottom of a stacked array to the top thereof. Such lengths can go to 30 feet.

As illustrated in FIGS. 5, 5A, 5B and 6, the integral stem 14 includes a plurality of pan inserts 33 arranged in two parallel rows and five parallel columns. In a preferred embodiment of the invention, the pan inserts 33 have a height of about 1 foot, 5 inches and a width of about 1 foot but may vary from about 1 foot to 1.5 feet in height and from about 0.5 feet to 1.0 feet in width. In addition, there are corresponding and aligned pan inserts 33 on each side of the integral stem 14 each of which constitutes a recess of about two inches. In this embodiment of the invention, the integral stem has a height of about 5 feet which is equal to the height of the face panel 12 and a width of about 7 inches which is slightly less than a thickness of about 8 inches for the face panel.

Figure 8:
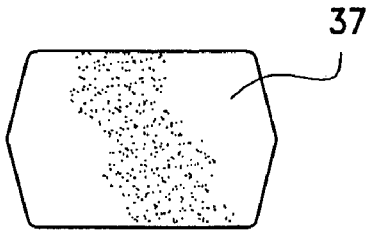
FIG. 8 is a side view of a shear-key in accordance with one embodiment of the invention.
Figure 9:
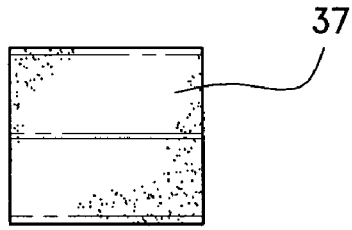
FIG. 9 is a front view of the shear key shown in FIG. 8.
Figure 10:
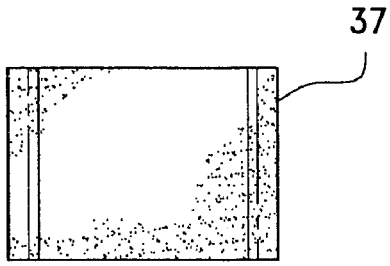
FIG. 10 is a plan view of the shear key shown in FIGS. 8 and 9.
Figure 11:
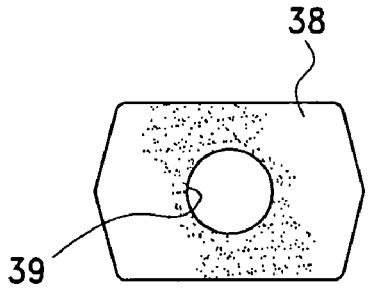
FIG. 11 is a side view in accordance with another shear key in accordance with the invention.

A further embodiment of the present invention relates to a shear key as illustrated in FIGS. 7–11, 17A and 17B. As illustrated, a shear key 37 is constructed and dimensioned to fit within the notches 30 or 32 and adapted to fit within a corresponding notch in an abutting stem 14 when placed on top of or below another retaining wall element. As illustrated, the shear key 37 is in the form of a polyhedron having eight sides with two opposite sides (a cross section) defining a hexagon. The key 37 is preferably about eight inches between opposite sides i.e., slightly larger than the seven inch width of the integral stem 14 so that it extends outwardly by about ½ inch on each side of the integral stem to facilitate handling of the shear key 37. FIGS. 8, 9 and 10 illustrate a shear key 37 which has a height of about 7½ inches and a width of about 11 inches from opposite sides of the hexagonal face and about 9 inches along the top and bottom thereof.

In a further embodiment of the invention, a shear key 38 includes a circular passage way 39 extending through the key from one hexagonal face side to the other to lighten the key and further facilitate handling.

In another embodiment of the invention (see for example, FIGS. 17A and 17B) the shear key 37 includes fully encased steel reinforcing rods 40 and 41. In this embodiment each of the reinforcing rods 40 and 41 are U-shaped with two legs and a connecting member. In this embodiment, the shear key includes a first portion adjacent to one of the hexagonal sides and a second portion adjacent to an opposite hexagonal side. A connecting member of a first U-shaped reinforcing rod 40 is disposed in and fully encased by the first portion of the shear key 37 with its leg portions extending into the shear key. Further, the connecting member of the second U-shaped reinforcing rod 41 is disposed in and fully encased by the second portion of the shear key 37 with its legs extending inwardly into the key 37. As illustrated, the connecting members of the reinforcing rods 40 and 41 are disposed in a crossed-relationship as illustrated in FIG. 17B.

Figure 3:
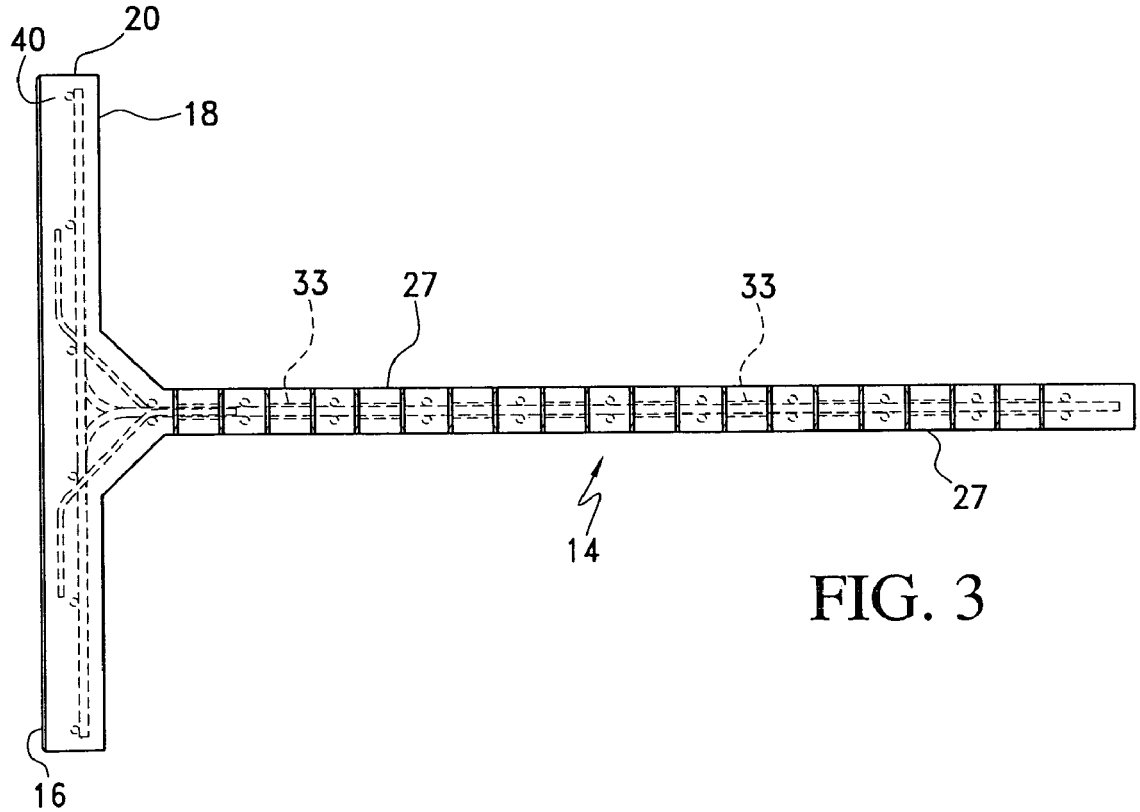
FIG. 3 is a top view of the element shown in FIG. 2.
Figure 12A:
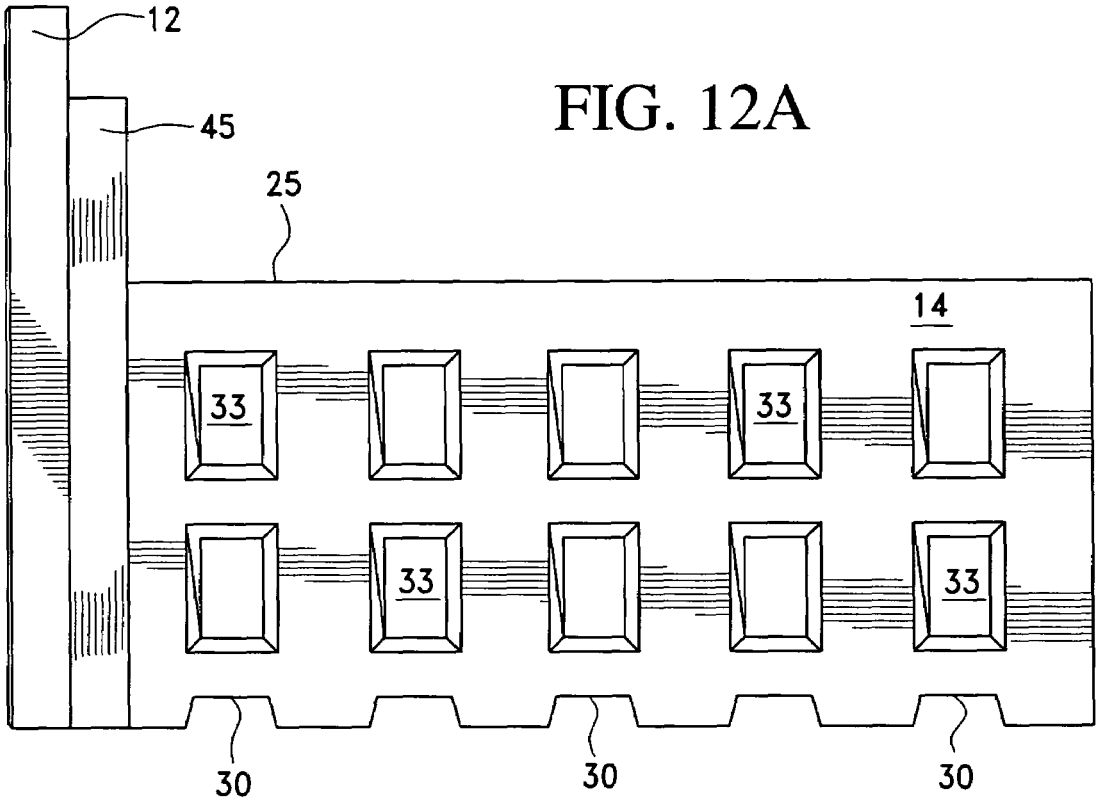
FIG. 12(*a*) is a side view of a retaining wall construction element in accordance with another embodiment of the invention.
Figure 12B:
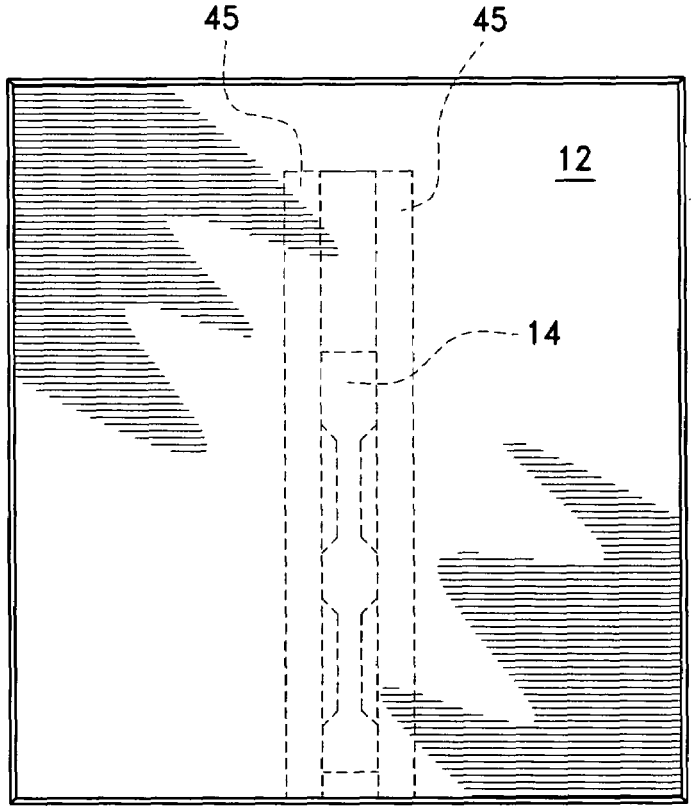
Figure 13:
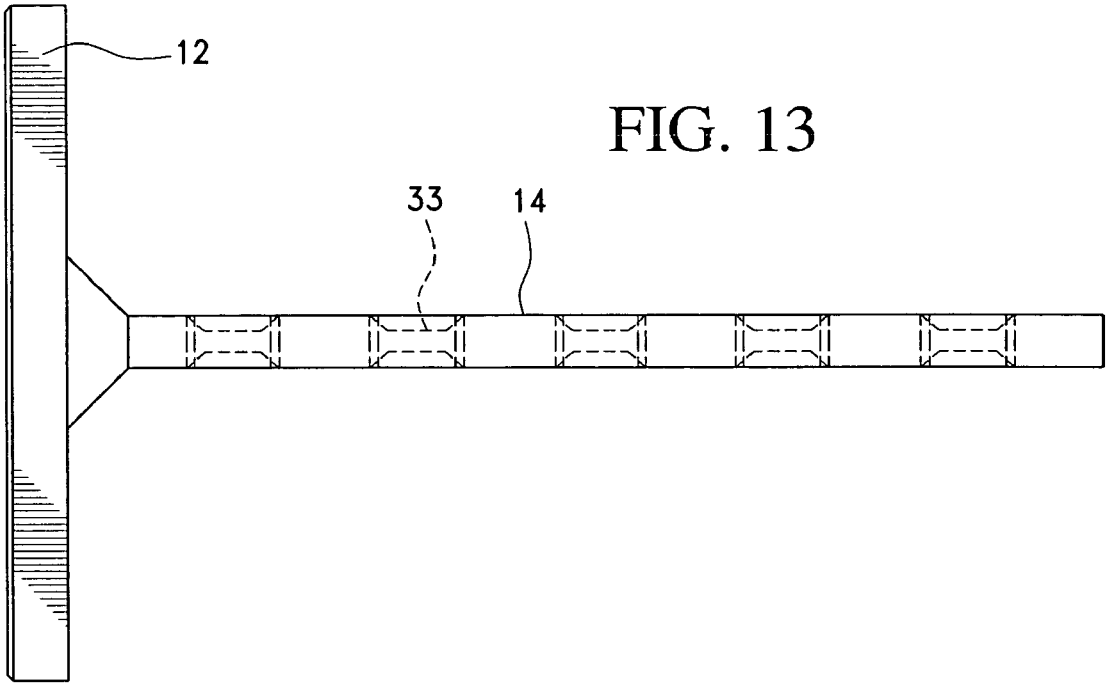
FIG. 13 is a top view of the elements shown in FIG. 12.
Figure 13A:
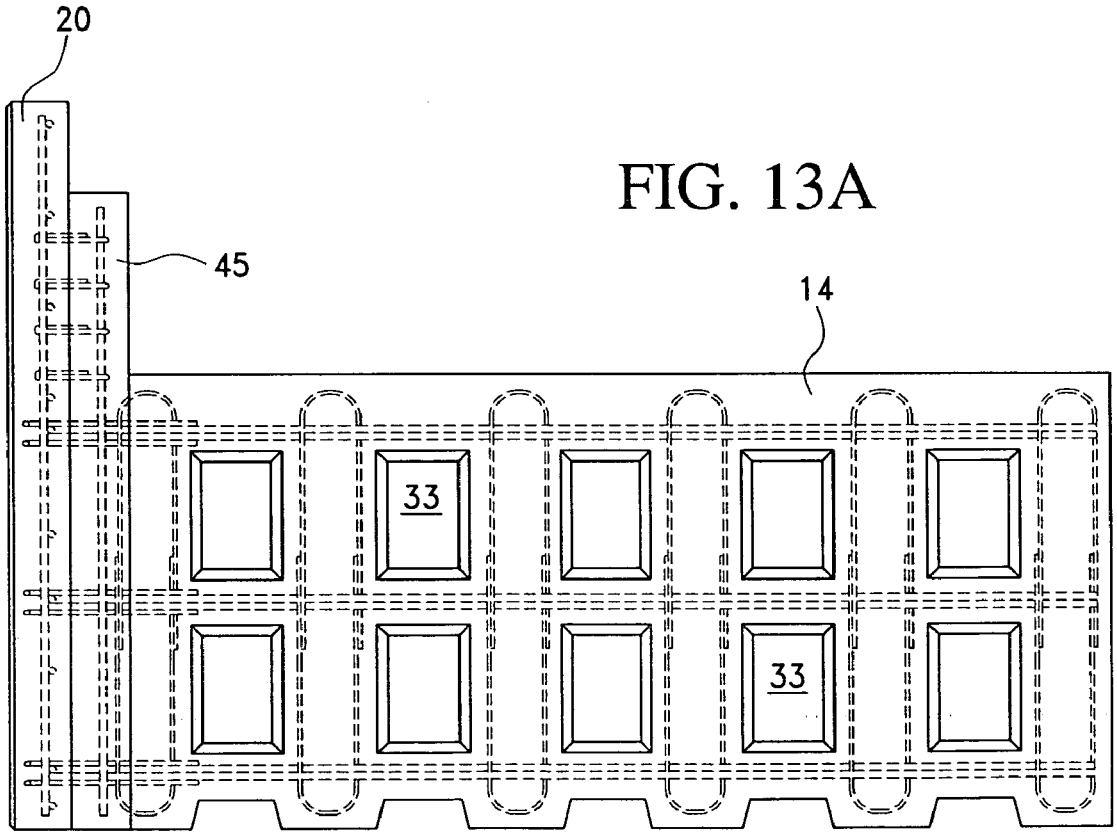
FIG. 13A is a sectional side view illustrating the steel bar reinforcement as used in one embodiment of the invention.
Figure 13B:
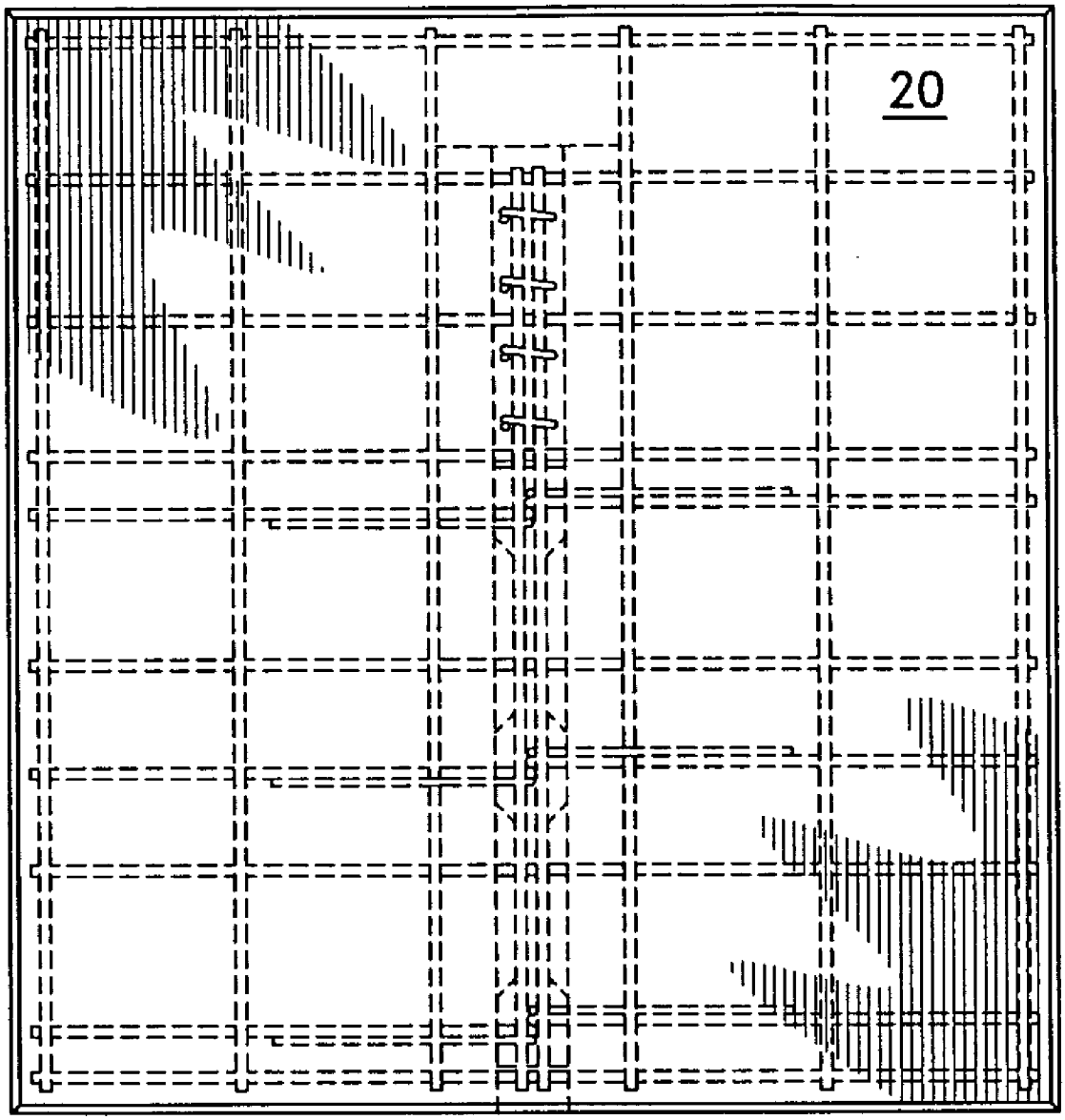
FIG. 13B is a sectional front view illustrating the steel bar reinforcement as used in the embodiment of the invention shown in FIG. 13A.

A still further embodiment of the invention as shown in FIGS. 12A, 12B and 13 is generally similar to the element shown in FIGS. 1–3. For example, the precast concrete remaining wall construction element in accordance with this embodiment of the invention includes a face panel 12 having a width of 7½ feet and a height of about 5 to 10 feet. The additional height i.e., above 5 feet is used in an uppermost element to resist movement of a top layer of soil in a railroad installation. The element also includes a integral stem 14, pan inserts 33 and notches 30 but does not include notches 32 in an upper wall 25 of the integral stem 14. A key feature in this embodiment of the invention resides in one or two integral reinforcing elements 45. This integral reinforcing element may take the form of a single wall or pair of walls as shown in FIG. 12B and extends above the integral stem by about ⅔'s of the distance to the top of the front wall 12. The reinforcing elements 45 may take the form of a pair of support walls 45 as shown in FIG. 12B.

Figure 14:
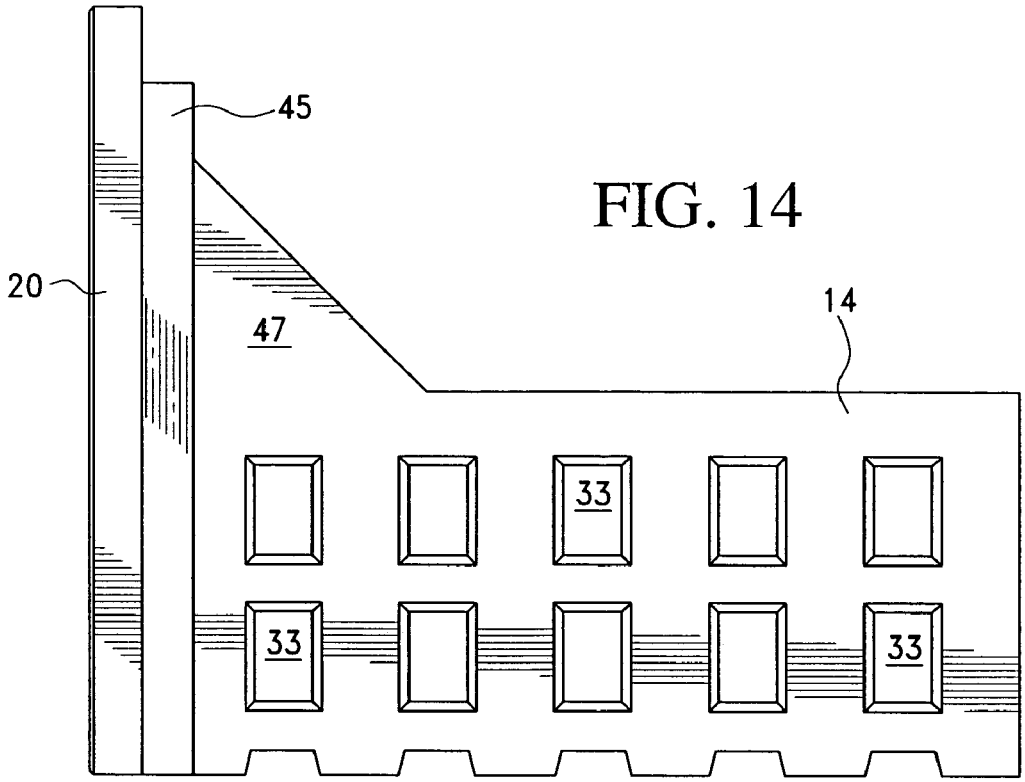
FIG. 14 is a side view of a retaining wall construction in accordance with another embodiment of the invention.
Figure 14A:
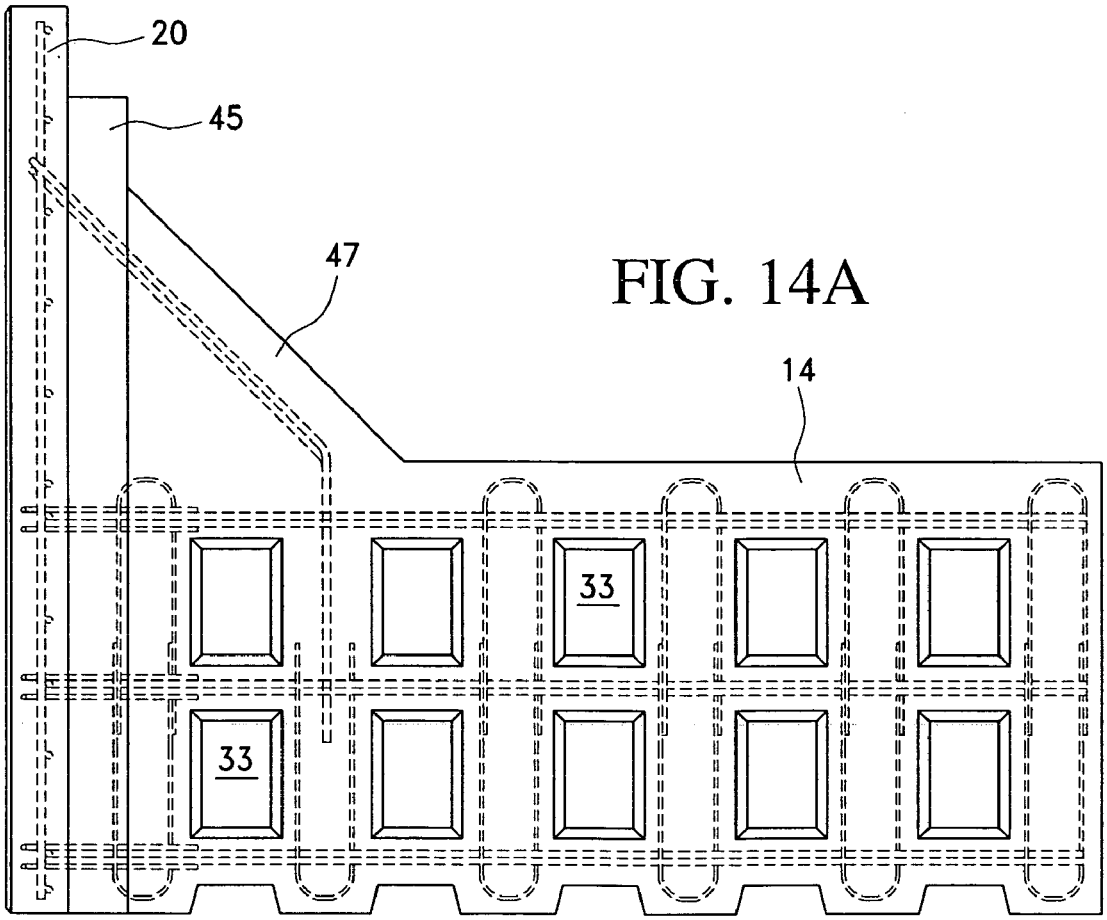
FIG. 14A is a side sectional view which illustrates the steel reinforcing rods in another embodiment of the invention.
Figure 14B:
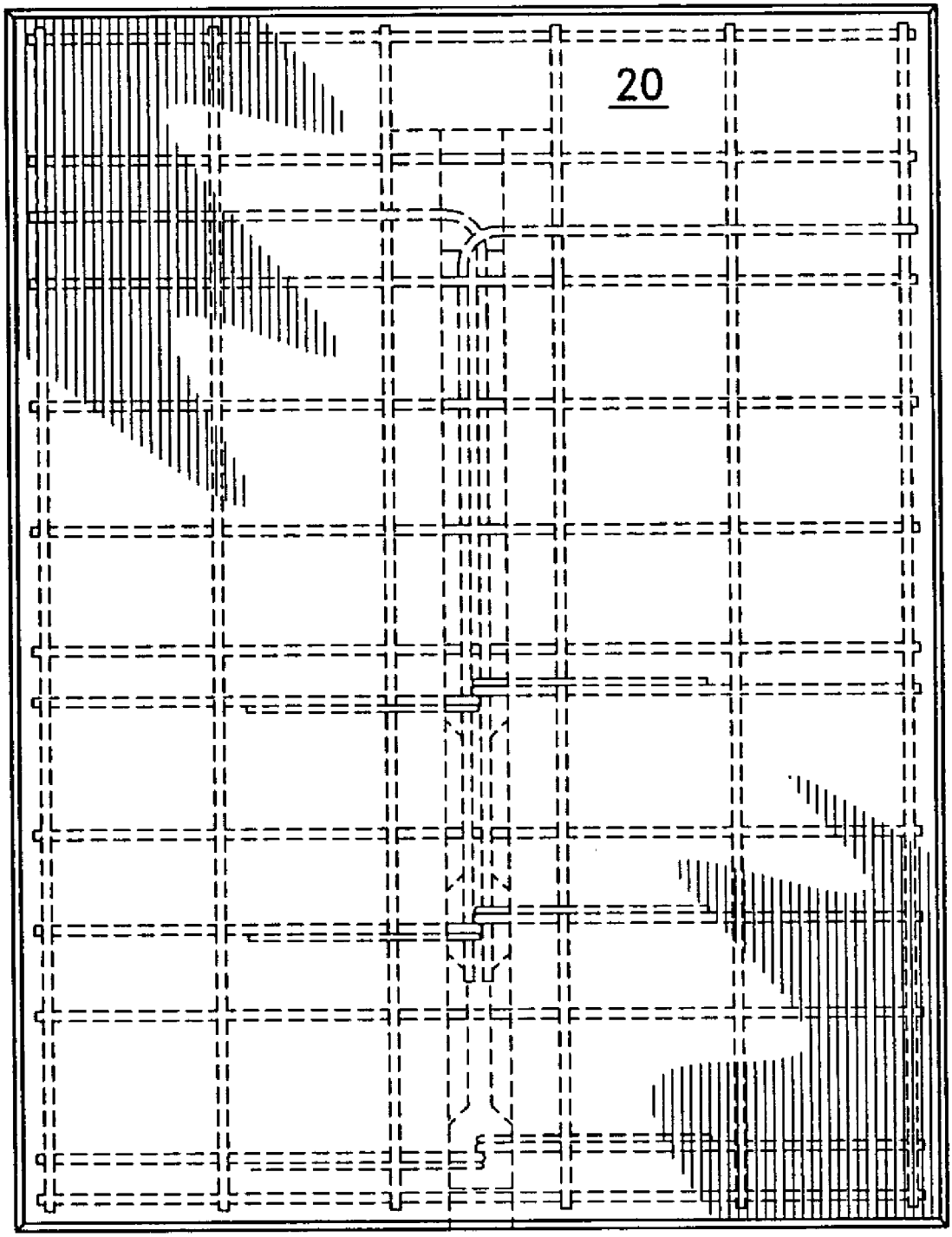
FIG. 14B is a front sectional view which illustrates the steel reinforcing rods in a face panel in accordance with the embodiment of the invention shown in FIG. 14A.

Another embodiment of the invention is illustrated in FIGS. 14, 14A and 14B. As shown in FIG. 14, a precast concrete retaining wall construction element is generally similar to the element shown in FIGS. 12A, 12B and 13 and includes a face panel 12, an integral stem 14 and a pair of integral reinforcing elements 45. However, as shown in FIG. 14, the element 2 also includes one or two buttresses 47 between the integral stem 14 and integral reinforcing element 45 to provide further support for an extending front panel 12. The buttresses 47 are used to provice further support for a front panel that extends upwardly from the upper wall of the integral stem 14 by between about 3 to 5 feet so that the front panel may have a height of between 8 to 10 feet.

In the aforementioned embodiment, as shown in FIG. 14, it may also be desirable to provide further reinforcement with rebars or other steel reinforcing rods as shown in FIGS. 14A and 14B. As shown in FIG. 14A, a pair of rebars pass through and are encased by the panel 12, reinforcing elements 45 and buttresses 47 and extend down into the integral stem 14. In addition, the integral stem 14 includes a plurality of U-shaped reinforcing rods between columns of pan inserts as well as a plurality of rebars above, between and below the rows of pan inserts.

FIGS. 15 and 16 illustrate a modification of the embodiment shown in FIGS. 14, 14A and 14B. In FIGS. 15 and 16, the face panel 12 has a height of between about 5 feet, 6 inches to about 7 feet, 6 inches and integral stem 14 of about 2 feet, 6 inch height. The integral stem 14 includes a single row of pan inserts 33 with a pair of rebars above the pan inserts and a pair of rebars below the inserts. Reinforcing rods extend from an upper portion of the face panel through the buttresses and into the integral stem 14. The configuration of reinforcing rods of the face panel is shown in FIG. 16.

Figure 18:
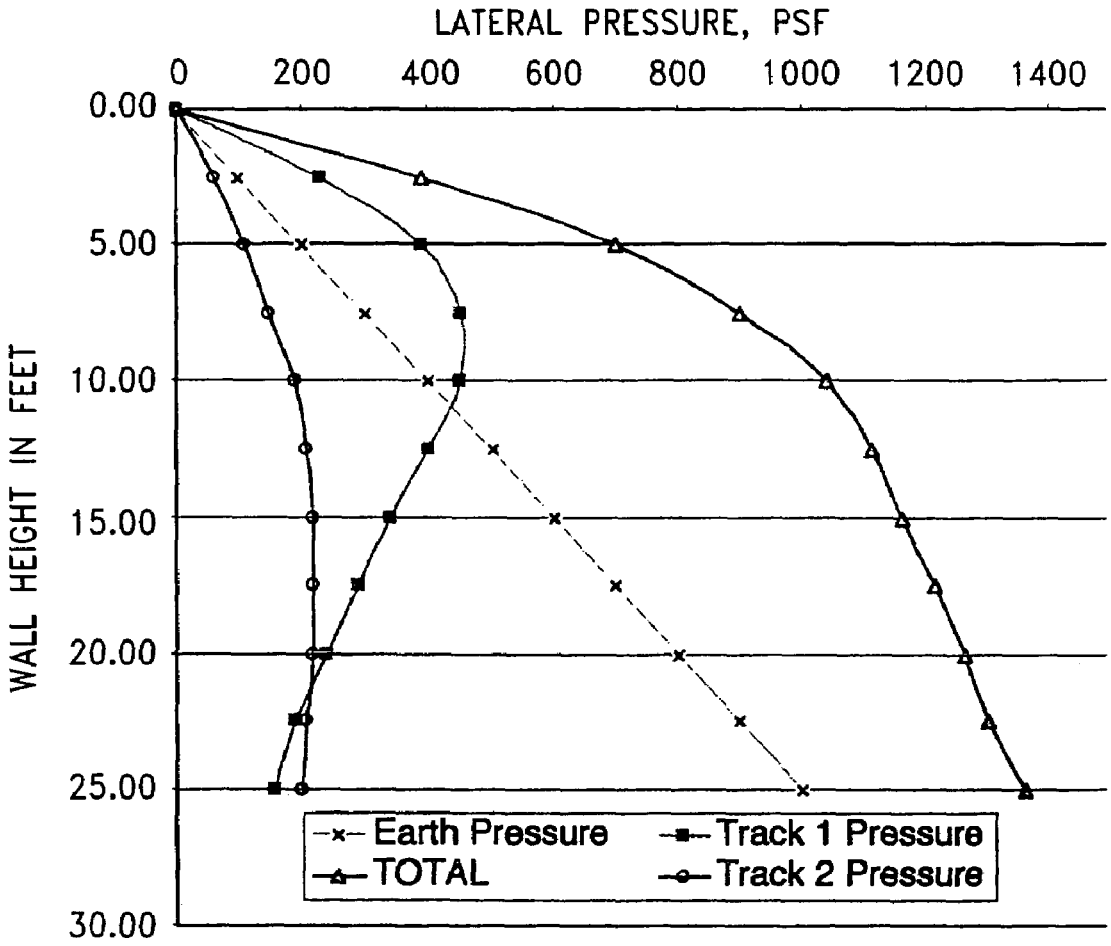
FIG. 18 is a load diagram which illustrates typical lateral earth pressures from two railroad tracks adjacent to a retaining wall construction in accordance with the present invention.

FIG. 18 is a load diagram that shows typical lateral earth pressures from two railroad tracks adjacent to a retaining wall construction in accordance with the present invention. The standard heavy rail (Cooper E-80) load applied for the present invention is 1,882 pounds per square foot of track and is based on AREMA, Section 2.2.3C. The retaining wall construction is designed for the sum of the lateral earth pressure plus the surcharge loads from the adjacent tracks. The lateral earth pressure from the train surcharge was calculated as a strip load based on a Boussinesq distribution as provided in AREMA, Section 20.3.2.2. Other consideration in developing precast concrete retaining wall construction elements in accordance with the present invention include manufacturing and raw material costs, shipping costs, safety of the workers, labor costs, etc.

Figure 19:
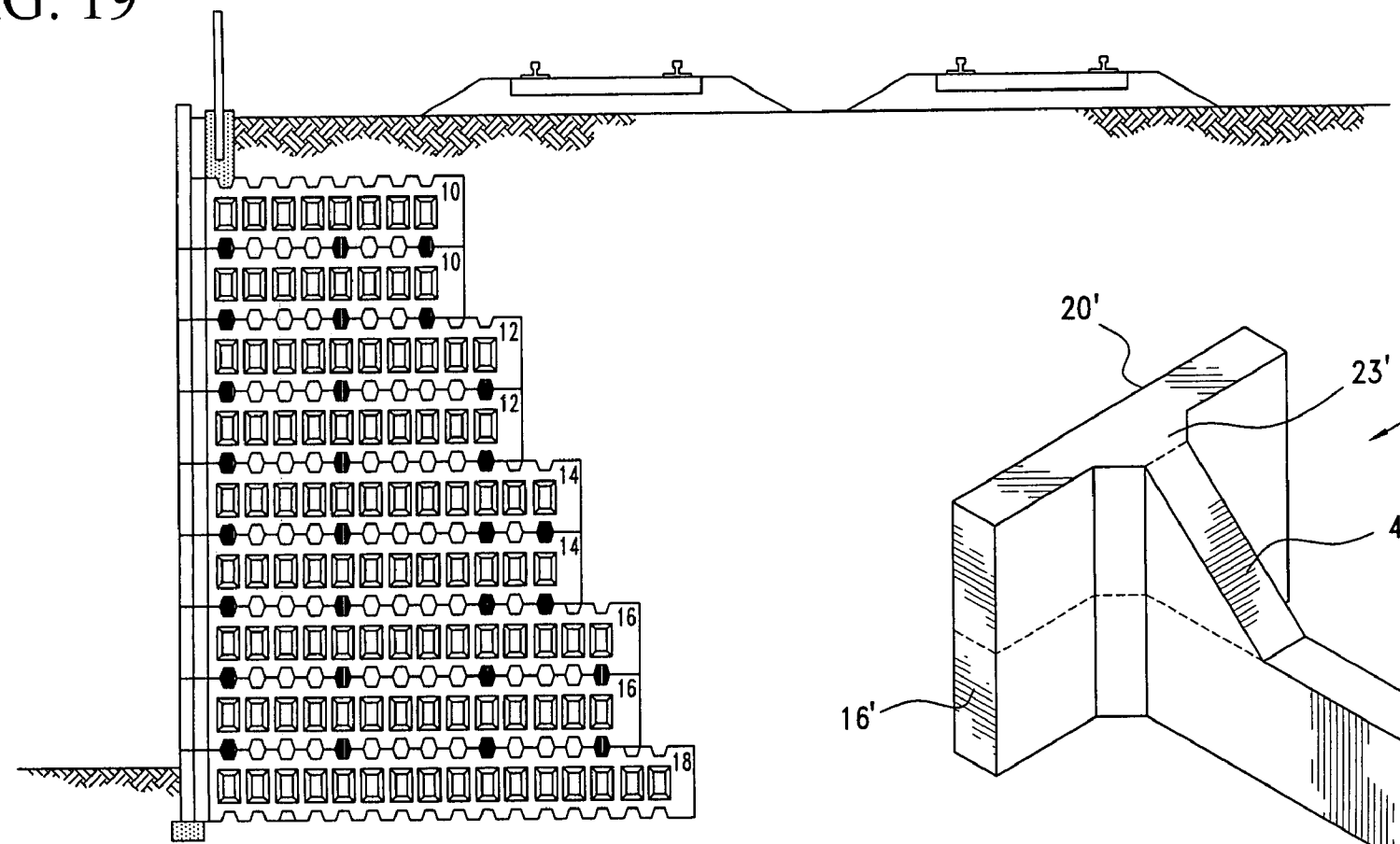
FIG. 19 is a side view of a typical rail facility application.

A typical railroad application is illustrated in FIG. 19. Such applications may be applicable for grade separation structures, bridge approaches and abutments, track widening, slope stabilization, railroad yard improvements, platforms, service and access roads, loading and unloading facilities and wing walls.

Figure 20:
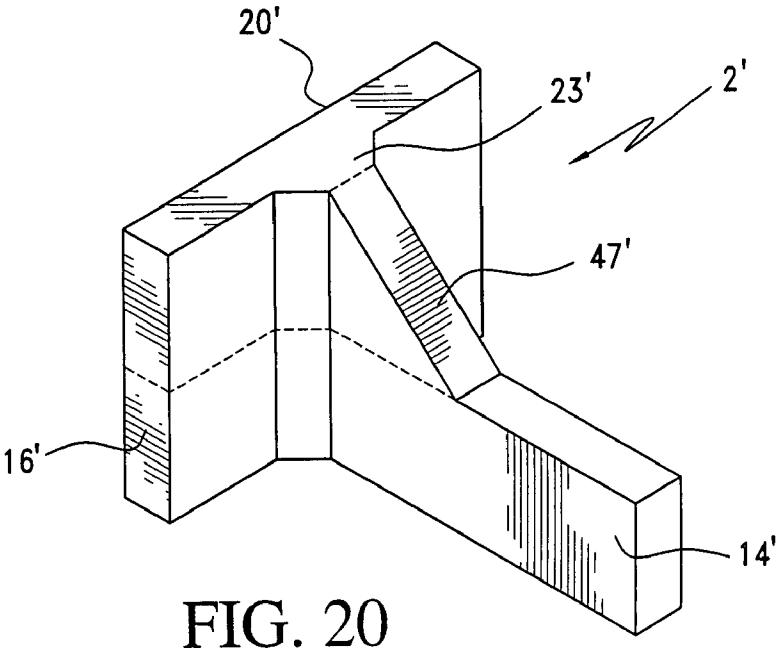
FIG. 20 is a perspective view of one embodiment of the invention.

FIG. 20 illustrates one form of the invention, which is particularly applicable for railroad installation. As shown, a precast concrete retaining wall construction element 2' includes a face wall 16' having an upper extension 20', a support member or haunch 23' and a buttress 47' which connects the upper extension 20' and integral stem 14'.

It should also be recognized that at times the upper extension may be added to any of the standard units which presently include half units having a face panel with a height of 2½ feet and width of 7½ feet, a ¾ unit wherein the face panel is 3.75 feet by 7½ feet and a full unit which is 5 feet by 7½ feet and wherein the maximum height of a unit is 10 feet.

While the invention has been described in connection with its preferred embodiments, changes and modifications may be made therein without departing from the scope of the appended claims.

What is claimed is:

1. A precast concrete retaining wall construction element and shear key for retaining a soil mass, comprising:

an upstanding solid face panel having a shape of a hexahedron with front and rear walls, a top wall, two side walls and a bottom wall and where the are of said front wall is between about 30 and about 40 square feet and the ratio of the width of said face panel to the height of said face panel is between about 1.2 to about 1.6;

an integral stem extending rearwardly from said rear wall of said face panel and in a generally T-shaped arrangement for embedment in the soil mass;

said integral stem having an upper wall, a bottom wall, two side walls, a rear wall and said upper and bottom wall each defining a notch therein and each of said side walls including a pan insert therein;

the shear key in the form of a polyhedron constructed to fit within one of said notches in one of said upper and bottom walls and adapted to fit within a corresponding notch in an abutting stem of a second element placed on top of or below said retaining wall construction element;

said shear key including a face having a cross-sectional area in the shape of a hexagon and defining an area of about one square foot; and which includes two U-shaped reinforcing bars each of which includes two leg portions and a connecting member.

2. A precast concrete retaining wall construction element and shear key for retaining a soil mass, comprising:

an upstanding solid face panel having a shape of a hexahedron with front and rear walls, a top wall, two side walls and a bottom wall and where the area of said front wall is between about 30 and about 40 square feet and the ratio of the width of said face panel to the height of said face panel is between about 1.2 to about 1.6;

an integral stem extending rearwardly from said rear wall of said face panel and in a generally T-shaped arrangement for embedment in the soil mass;

said integral stem having an upper wall, a bottom wall, two side walls, a rear wall and said upper and bottom wall each defining a notch therein and each of said side walls including a pan insert therein;

the shear key in the form of a polyhedron constructed to fit within one of said notches in one of said upper and bottom walls and adapted to fit within a corresponding notch in an abutting stem of a second element placed on top of or below said retaining wall construction element;

said shear key including a face having a cross-sectional area in the shape of a hexagon and defining an area of about one square foot;

which includes two U-shaped reinforcing bars each of which includes two leg portions and a connecting member; and in which said shear key includes a first portion adjacent to a first hexagonal shaped face and a second portion adjacent to an opposite hexagonal face and in which a connecting member of a first of said U-shaped reinforcing bars is disposed in a first portion and a connecting member of the second of said U-shaped reinforcing bars is disposed in said second portion but in a crossed relationship with said connecting member of said first of said U-shaped reinforcing bars and wherein said leg portions of each of said U-shaped reinforcing bars extend inwardly in an overlapping relationship with the leg portions of the other U-shaped reinforcing bar.

* * * * *